United States Patent [19]

Schulz

[11] 4,128,041

[45] Dec. 5, 1978

[54] WEAPON ELEVATING MECHANISM HAVING AN AUTOMATIC CLUTCH

[75] Inventor: Robert J. Schulz, Davenport, Iowa

[73] Assignee: The United States of America as represented by the Secretary of the Army, Washington, D.C.

[21] Appl. No.: 838,775

[22] Filed: Oct. 3, 1977

[51] Int. Cl.[2] ..... F41F 21/04

[52] U.S. Cl. ..... 89/41 R; 89/37 H

[58] Field of Search ..... 89/37 H, 40 R, 41 R

[56] References Cited

U.S. PATENT DOCUMENTS 2,696,761 12/1954 Chinn ..... 89/41 R

*Primary Examiner*—Stephen C. Bentley

*Attorney, Agent, or Firm*—Nathan Edelberg; Robert O. Richardson

[57] ABSTRACT

A weapon elevating mechanism having an automatic clutch to lock the mechanism at preselected elevation yet automatically release it for vertical movement upon actuation of the elevating input structure.

10 Claims, 5 Drawing Figures

WEAPON ELEVATING MECHANISM HAVING AN AUTOMATIC CLUTCH

GOVERNMENT RIGHTS

The invention described herein may be manufactured and/or used by or for the Government for governmental purposes without the payment of any royalty thereon.

BACKGROUND OF THE INVENTION

Heretofore, difficulties have been encountered in precise aiming and locking of artillery weapons. Once an artillery weapon is aimed toward a target, it must be locked in position to prevent recoil forces from damaging the aiming mechanisms or altering the trajectory of a second projectile. Imperfect equilibration can also effect the trajectory; i.e., the weight of the gun tube and other tipping parts could change the point of aim if not locked in position. An early type of elevation locking mechanism consisted of simply a pin which passed through spaced holes in adjacent parts of the cannon cradle. This method allowed the weapon to be aimed only at elevations where the spaced holes aligned and the pin could be inserted. If more precise positioning was required, the entire weapon had to be tilted.

More recently artillery elevating systems utilize ball screw mechanisms which are actuated by handwheels near the weapon operator. A ball screw is a threaded shaft with a mating nut. The nut is carried by ball bearings rather than mating directly to the shaft. This greatly reduces friction, resulting in very smooth and efficient operation. The weapon must still be locked on target for reasons previously stated. Hydraulic locks have been experimented with but this required both hands and a two step operation to lock or unlock the elevating mechanism. This increases the time it takes to aim the weapon and further complicates weapon operation. Commercially available automatic clutches have also been tried but are prone to slipping when used with larger caliber weapons. While these locking systems are capable of locking at virtually any angle of elevation, they do not meet modern requirements because of these disadvantages.

SUMMARY OF THE PRESENT INVENTION

The weapon elevating mechanism of the present invention utilizes an automatic clutch. The clutch releases automatically when the handwheel is rotated to raise or lower the weapon and engages automatically when rotation of the handwheel ceases.

The clutch includes two or more plates having a large circular opening centrally located in each plate. These openings have ratchet teeth around their circumferences which are engaged by pawls in the clutch mechanism. The teeth are staggered in each plate to allow more precise engagement of the clutch. Additional plates may be added if greater precision is required. The plates are positioned over a set of coaxial shafts. The inner shaft is an input or driving shaft and is connected, through a gear box, to the handwheel. The tubular outer shaft is the driven or output shaft which is connected to the ball screws. A projection on the input shaft is pivotally mounted to a link. The link is connected to a pair of pawls by means of pins on the lower end of the pawls engaging elongated slots in the link. The pawls are pivotally mounted to projections on the output shaft and urged into engagement with the ratchet teeth by means of a helical spring between the upper ends of the pawls. It should be understood that each plate used has separate pawls and links. Initial rotation of the handwheel causes the link to disengage the pawls from the ratchet teeth. Continued rotation of the handwheel causes the output shaft to rotate with the input shaft. When the desired elevation is achieved the handwheel is released and the spring urges the pawls back into engagement with the ratchet teeth to lock the mechanism in place.

DETAILED DESCRIPTION OF ILLUSTRATIVE EMBODIMENTS

Figure 1:
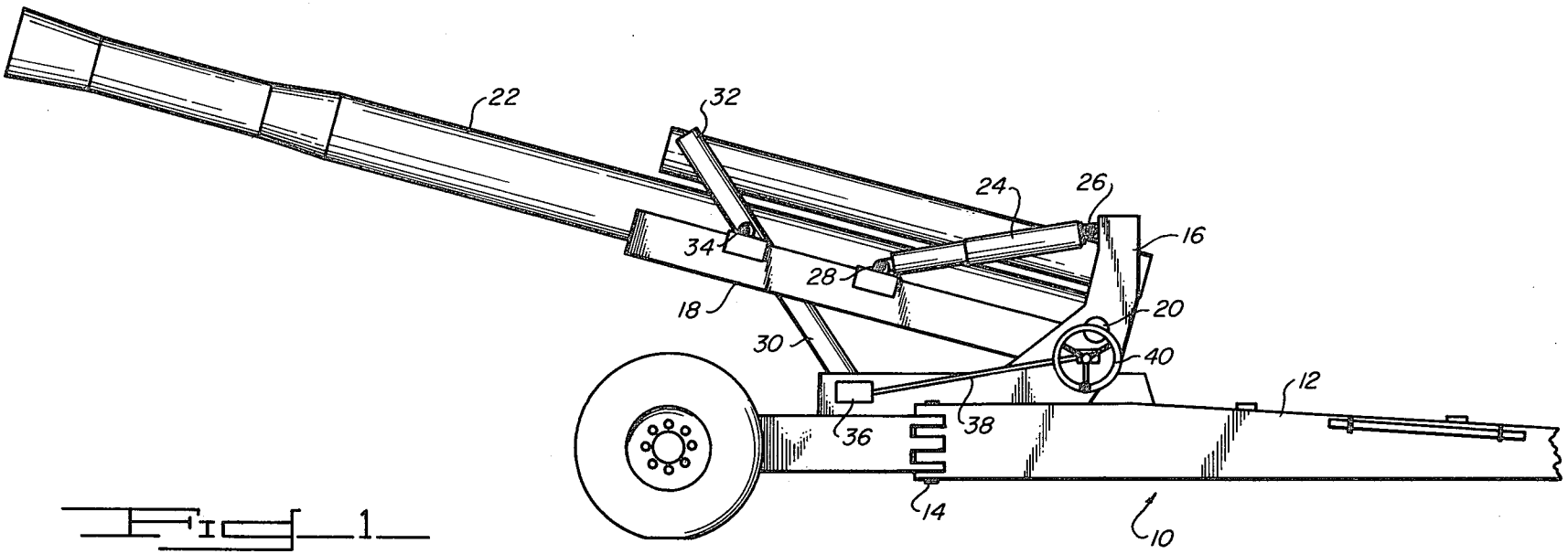
FIG. 1 is a side elevational view of artillery weapon.

Referring now to FIG. 1 there is shown a towed artillery weapon 10. It has legs 12 attached to a vehicle for towing and are pivotable outwardly at pivots 14 for support for firing the weapon. Attached to frame 16 is the gun tube cradle 18 which pivots on trunnion 20. The gun tube 22 recoils on cradle 18 when fired. An equilibrator 24 is pivotally connected at 26 to frame 16 and at 28 to cradle 18. It expands or contracts during elevational movement of the gun tube 22 and it tends to hold the gun tube in balance after the operator has elevated it to the desired position.

A ball screw mechanism is used as the elevator 30 to elevate the gun tube 22. Shown is a housing 32 pivotally attached at 34 to cradle 18. Within the housing 32 is a screw shaft, shown in FIG. 5, rotatably mounted on frame 16 and rotatable through gear box 36 and actuator shaft 38 and operator's handwheel 40. Between the gear box 36 and elevator housing 32 is the clutch mechanism to be hereinafter described.

The criteria for towed artillery weapons, such as shown in FIG. 1, emphasizes light weight, mechanical efficiency, reliability, and maintainability. The ball screw has become the standard driving element in the elevating mechanism because it provides high load carrying capability, inexpensive availability, and very high mechanical efficiency. Imperfect equilibration and especially firing forces, however, tend to displace the tipping parts unless they are locked in place at the elevation set by the gun crew. For this reason an automatic clutch mechanism has been added to the ball screw driving element in the elevating unit to automatically lock the ball screw from movement until it is deliberately reset by the operator, at which time it is automatically released.

Figure 2:
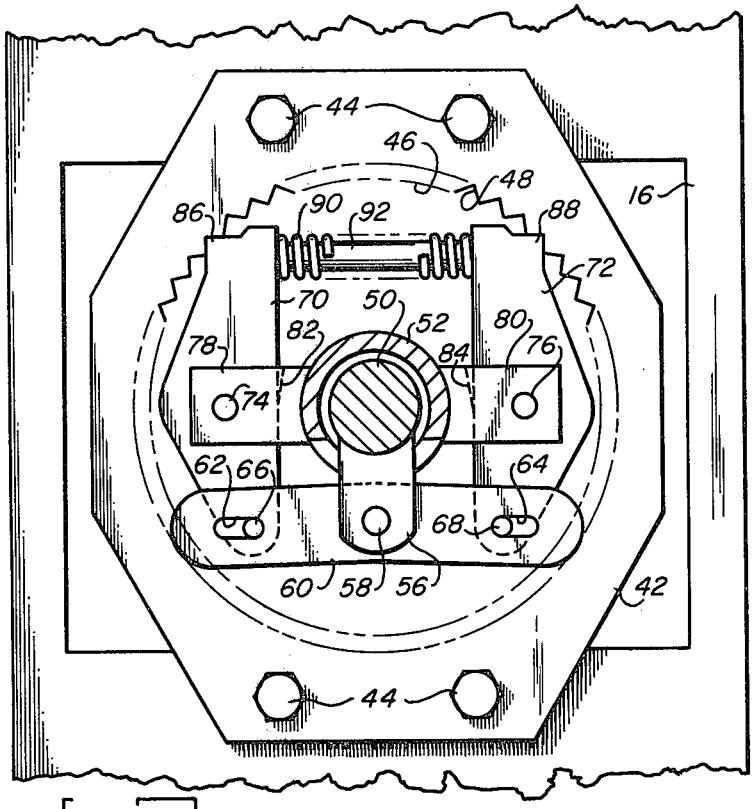
FIG. 2 is an elevational end view of the clutch in locked position.

FIG. 2 is an elevational end view of the automatic clutch shown in locked position. This includes a plate 42 attached to frame 16 by means of bolts 44. A large circular opening 46 is provided, with ratchet teeth 48 around the opening circumference. Extending through the opening 46 are coaxial shafts 50, 52. The inner shaft 50 is the input or driving shaft and is connected through the gear box 36, shown in FIG. 1, to shaft 38 and the operator's handwheel 40. The tubular outer shaft 52 is the driven or output shaft which rotates the ball screw shaft 54, shown in FIG. 4. The rest of the structure shown in FIG. 2 interconnects the two shafts 50, 52 to cause shaft 52 to rotate with rotation of shaft 50.

A projection 56 extends from inner shaft 50 and is pivotally connected at 58 to an actuating link 60. This link has a pair of slots 62, 64 in which pins 66, 68 may move. These pins are affixed to and extend from pawls 70, 72. These pawls 70, 72 are pivotally mounted at 74, 76 to outwardly extennding ears 78, 80 which extend from the driven shaft 52. These ears 78, 80 have shoulders 82, 84 which limit the pivotal movement of these pawls 70, 72 relative to the ears 78, 80. It thus can be seen that rotation of driving shaft 50 will cause rotation of driven shaft 52.

The structure just described interconnects the two shafts 50, 52. Its locking feature will now be described. Each pawl 70, 72 has an engaging tooth 86, 88 which engages ratchet teeth 48 on plate 42. Spring 90 over spring guide 92 extends between the pawls 70, 72 to urge the teeth 86, 88 into contact with the ratchet teeth 48. This prevents rotation of driven shaft 52, as shown in FIG. 2. Tooth 86 engaging ratchet teeth 48 prevents clockwise rotation of driven shaft 52 and tooth 88 engaging ratchet teeth 48 prevents counterclockwise movement of driven shaft 52. It should be noted that pins 66, 68 engage the inner ends of slots 62, 64.

Figure 3:
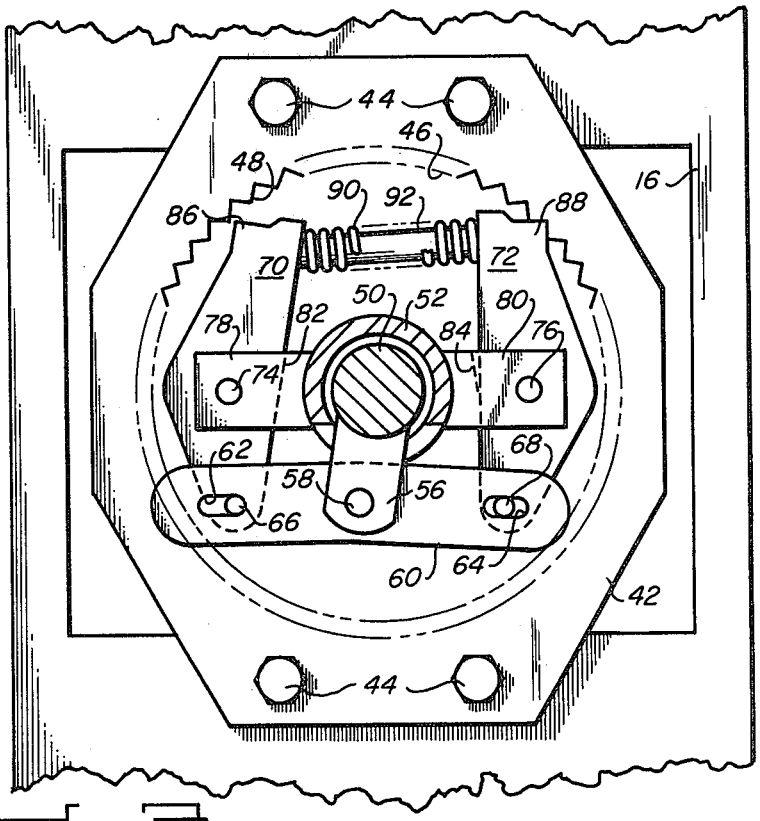
FIG. 3 is an elevational end view of the clutch in unlocked position.

The input or driving shaft 50, upon clockwise rotation to the position shown in FIG. 3, automatically unlocks the locking clutch mechanism and causes rotation of the output or driven shaft 52. As shown in FIG. 3, upon clockwise rotation of shaft 50, projection 56 has moved the actuating link 60 to the left. Since pin 66 already engaged the innermost portion of slot 62, pawl 70 is rotated clockwise about pivot 74, freeing tooth 86 from ratchet teeth 48, all as shown in FIG. 3.

The movement of link 60 to the left does not affect pawl 72 since pin 68 engaged the innermost portion of slot 64 before it was moved. The slot merely passes to the left and pin 68 is unmoved. However, it should be noted, from the angle or rake of tooth 88 and the direction of rotation of pawl 72 as it moves clockwise about opening 46, that pawl 72 does not serve as a lock against clockwise rotation but merely chatters against the ratchet teeth 48 as shafts 50, 52 rotate clockwise.

When the desired rotation of the driven shaft 52, and ball screw shaft 54 (shown in FIG. 4), has achieved the desired gun tube elevation, a slight counterrotation of the operator's handwheel 40 (shown in FIG. 1) will relock the output or driven shaft 52. This counterrotation of input shaft 50 is a counterclockwise rotation, as shown in FIG. 3. At this time the structure as shown in FIG. 3 reverts back to its position shown in FIG. 2. The rake of tooth 86 and its engagement with ratchet teeth 48 prevent any clockwise rotation, and the rake of tooth 88 and its engagement with ratchet teeth 48 prevent any counterclockwise rotation.

While the structure as shown in FIGS. 2 and 3 has been described with reference to locking and unlocking output shaft 52 when input shaft 50 is rotated clockwise, it should be apparent that the structure also works with a counterclockwise rotation of input shaft 50. In this case link 60 is moved to the right, freeing tooth 88 on pawl 72 from its engagement with ratchet teeth 48.

While the automatic clutch elevating mechanism in FIGS. 2 and 3 has been described as if one plate and one set of structure interconnecting shafts 50 and 52 is used, more sets of apparatus may be used to achieve finer calibration in elevation of the gun tube; i.e., rotary position of output shaft 52. The subsequent plates 42 added to the system would be placed axially along the shafts, and each plate would have its corresponding link 60, pawls 70, 72, projection 56 from shaft 50 and ears 78, 80 extending from shaft 52. The only difference between the subsequent sets is that the ratchet teeth 48 are slightly angularly rotated so that the ratchet teeth on the various plates are not in radial alignment with each other. In this manner a pawl tooth locks on a ratchet tooth, for example, on a first plate. Continued rotation of the output shaft will cause locking with the second plate, third plate, etc. until the pawl tooth on the first set locks on the next adjacent ratchet tooth on the first plate. In this manner several locked settings are possible between adjacent ratchet teeth on the first plate for a finer calibration, as desired.

Figure 4:
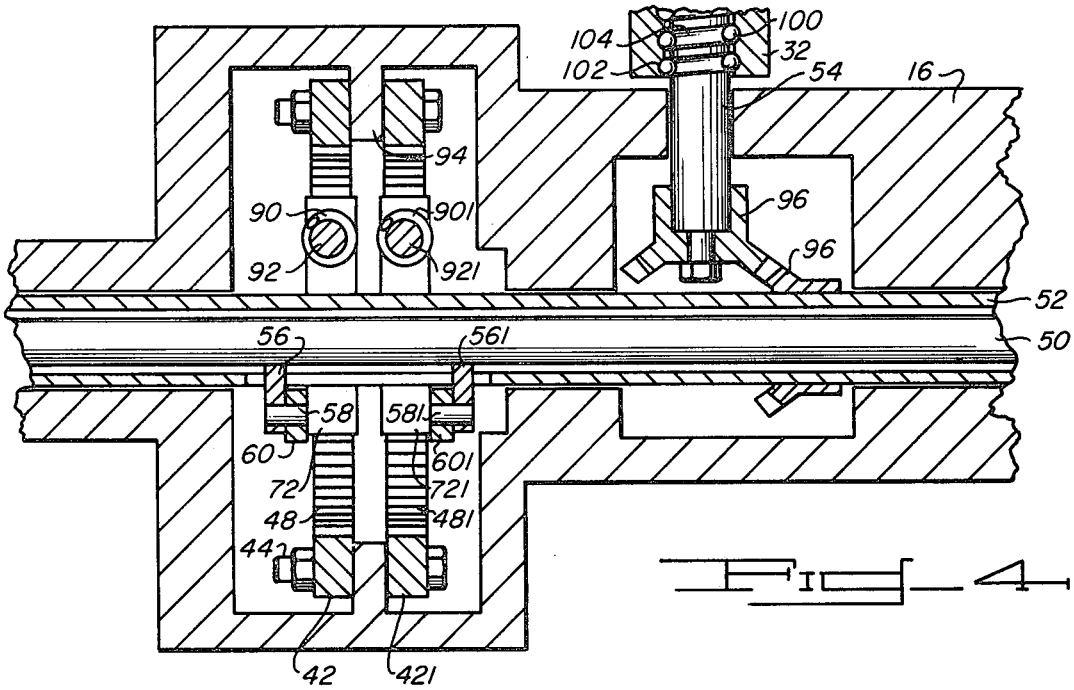
FIG. 4 is an elevational side view of the clutch, in section, showing the connection between the input shaft and the ball screw actuating shaft through the clutch structure.

FIG. 4 is an elevational side view of the clutch, in section, showing the connection between the input shaft and the ball screw actuating shaft through the clutch structure. In this embodiment two sets of clutch structure are used. As previously suggested, ratchet teeth 481 on plate 421 are slightly out of alignment radially from the ratchet teeth 48 on plate 42. Also, in order to mount both sets on one projection 94 on frame 16, plates 42 and 421 are fastened in either side and actuating links 60, 601 are positioned outwardly. Projections 56, 561 are spaced outwardly with their link pivot pins 58, 581 extending inwardly to support links 60, 601. The interconnection between input shaft 50 and output shaft 52 through this automatic clutch structure has previously been described.

FIG. 4 shows how the output shaft 52 rotates the ball screw shaft 54 through gears 96. The ball screw housing 32 is pivotally mounted to the gun tube cradle 18 as shown in FIG. 1 and does not rotate. Ball bearings 100 are mounted in spiral races 102 in sleeve or housing 32. They also rotate in spiral grooves 104 on the ball screw shaft 54. In this manner, rotation of shaft 54 causes vertical movement of the sleeve or housing 32. In this manner the gun tube cradle may be elevated as desired and locked in the desired elevation until further adjustment is made.

Figure 5:
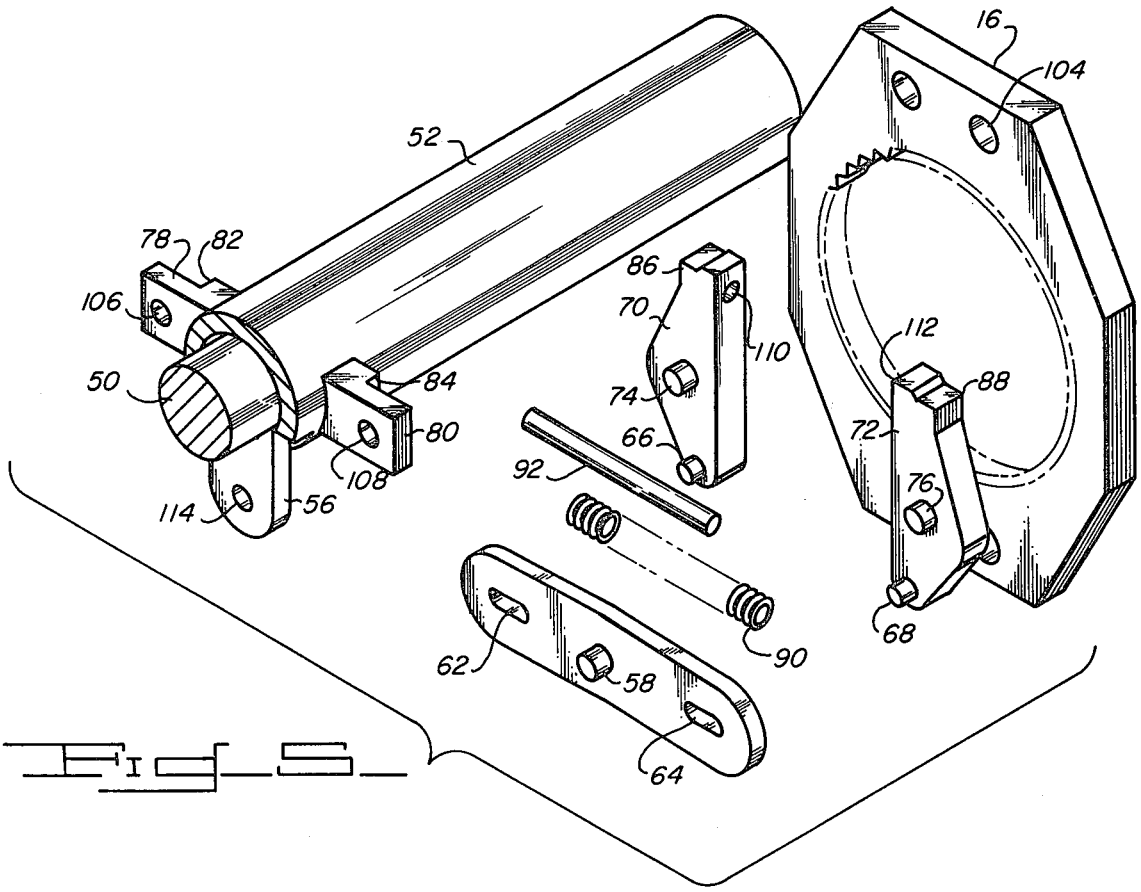
FIG. 5 is an exploded perspective view of the clutch components.

FIG. 5 is an exploded view, in perspective of the clutch components, illustrating their configuration and relative size. The plate 16 has four apertures 104 through which the bolts 44, in FIGS. 2 and 3, are inserted in fastening the plate to the frame 16. Pawls 70, 72 have pivots 74, 76 which rotate within apertures 106, 108 in ears 78, 80 extending from outer shaft 52. Spring guide fits within recesses 110, 112 in pawls 70, 72 while spring 90 fits over the guide and bears against the pawls. Actuating link 60 is suspended by pivot pin 58 which pivots in aperture 114 in projection 56.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. An artillery elevating mechanism for elevating a gun tube and cradle, said mechanism comprising:

a non-rotatable sleeve housing 32 attached to said gun tube and cradle, a rotatable shaft 54 within said housing operable on rotation to adjust the elevation of said housing, said rotatable shaft being geared to and driven by an outer output shaft 52, a manually operable rotatable inner input shaft 50, clutch means interconnecting said input shaft with said output shaft whereby rotation of said input shaft adjusts the elevation of said gun tube and cradle.

2. An artillery elevating mechanism as set forth in claim 1, said clutch means comprising pivoting linkages between said input and said output shafts.

3. An artillery elevating mechanism as set forth in claim 2 wherein said clutch means includes ears on said output shaft having pawls pivotally mounted thereon, said input shaft having a projection thereon with an actuating link pivotally mounted thereon, said pawls being pivotally connected to said link.

4. An artillery elevating mechanism as in claim 3, said ears having shoulders thereon against which said pawls abut to limit pivotal movement thereof.

5. An artillery elevating mechanism as in claim 3, wherein said pawls are pivotally and slidably connected to said link through elongated slots on said link.

6. An artillery elevating mechanism as set forth in claim 1 wherein said clutch locks said output shaft from rotation until said input shaft is rotated.

7. An artillery elevating mechanism as in claim 6 wherein said clutch includes a plate having ratchet teeth thereon, linkage including pawls with engaging teeth engagable with said ratchet teeth, said linkage interconnecting said output shaft with said input shaft, said being operable by rotation of said input shaft to disengage said engaging teeth from said ratchet teeth to permit rotation of said output shaft.

8. An artillery elevating mechanism as in claim 7 wherein said ratchet teeth are on the periphery of an opening in said plate, said pawls being pivotally mounted on said output shaft, said input shaft having means thereon for pivoting said pawls upon rotation of said input shaft.

9. An artillery elevating mechanism as in claim 8 wherein said means on said input shaft is a projection with an actuating link pivotally mounted thereon, said actuating link being pivotally and slidably connected to each of said pawls.

10. An artillery elevating mechanism as in claim 7 wherein spring means between said pawls urge their engaging teeth into engagement with said ratchet teeth.

* * * * *